United States Patent [19]

Tanimoto

[11] Patent Number: 4,652,111

[45] Date of Patent: Mar. 24, 1987

[54] ELECTROSTATIC RECORDING APPARATUS

[75] Inventor: Yoshihiro Tanimoto, Hyogo, Japan

[73] Assignee: Sanyo Electric Co., Ltd., Japan

[21] Appl. No.: 753,179

[22] Filed: Jul. 9, 1985

[30] Foreign Application Priority Data

Sep. 17, 1984 [JP] Japan ..... 59-194123

[51] Int. Cl.[4] ..... G03G 15/06

[52] U.S. Cl. ..... 355/3 DD; 355/14 D

[58] Field of Search ..... 355/14 D, 3 DD, 3 R; 222/DIG. 1

[56] References Cited

U.S. PATENT DOCUMENTS 3,892,672 7/1975 Gawron ..... 355/3 DD 3,932,034 1/1976 Takahashi ..... 355/3 DD 4,032,227 6/1977 Hubbard et al. ..... 355/14 D

*Primary Examiner*—R. L. Moses

*Attorney, Agent, or Firm*—Darby & Darby

[57] ABSTRACT

An electrostatic recording apparatus comprises a photosensitive body whereon an electrostatic latent image is formed and the electrostatic latent image is toner-developed by a developing apparatus. The developing apparatus is fed with a toner from a toner hopper. When at least two of plural operating keys arranged in an operation panel, for example, a copy quantity setting key and a start key, are operated at the same time or in sequence, respondingly, a toner feeding roller is operated for a predetermined time and thereby a predetermined amount of toner can be fed to the developing apparatus from the toner hopper. A key dedicated to command feeding the toner can be dispensed with.

2 Claims, 5 Drawing Figures

ELECTROSTATIC RECORDING APPARATUS

BACKGROUND OF THE INVENTION

1. Field of the Invention

The present invention relates to an electrostatic recording apparatus. More specifically, the present invention relates to an electrostatic recording apparatus which can feed a toner stored in a toner hopper into a developing apparatus at any time.

2. Description of the Prior Art

In the conventional electrophotographic copying machine using the toner (for example, the electrophotographic copier Model "SF-741" manufactured by Sharp Corporation), a key such as a toner button dedicated to command of feeding the toner from the toner hopper to the developing apparatus is installed in addition to the normal operating keys.

Usually, the toner is fed automatically to the developing apparatus and is not fed by an operation of the operator, being fed forcedly by the operator only in the case where the toner is not fed properly to the developing apparatus for some reason. Accordingly, the exclusive key as described above is scarcely used. However, the situation may still arise where it is necessary for the machine operator to feed toner to the developing apparatus manually, and therefore this key cannot be completely eliminated and presently a key dedicated to this function must be installed, which will increase the cost of the machine.

As described above, conventionally, the apparatuses have suffered from cost increases because of installing the key dedicated to feeding the toner to the developing apparatus.

Also, when the key is dedicated to feeding the toner is installed, the operator or the like may touch the key by mistake and thereby an even larger amount of toner than required for the developing apparatus is fed and resultingly a so-called "fogging" might occur.

SUMMARY OF THE INVENTION

Therefore, a principal object of the present invention is to provide a novel electrostatic recording apparatus which eliminates a key dedicated to feeding a toner.

In brief, the present invention is an electrostatic recording apparatus which comprises a photosensitive body whereon an electrostatic latent image is formed, developing means for toner-developing the electrostatic latent image, a toner hopper wherein the toner is stored, toner feeding means for feeding the toner to the developing means from the toner hopper, a plurality of operating keys which individually cannot operate the toner feeding means, and means for operating the toner feeding means for a predetermined time by operating at least two of the above-mentioned operating keys at the same time or in sequence.

By operating at least two operating keys at the same time or in sequence, the toner is fed from the toner hopper to the developing means and therefore when the toner is not fed automatically for some reason, the operator can feed the toner to the developing means by operating the specific keys. Therefore, in accordance with the present invention, the key dedicated to feeding the toner from the toner hopper to the developing means can be dispensed with and thereby the cost can be reduced.

Also, since the toner is fed only after at least two operating keys are operated, the conventional risk of feeding the toner by mistake can be reduced.

Furthermore, the toner feeding requires operations of at least two operating keys and a role of security code can be played by informing only a specific operator of the method of operating these operating keys. Accordingly, a wasteful feeding of the toner can be prevented.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENT

Figure 1:
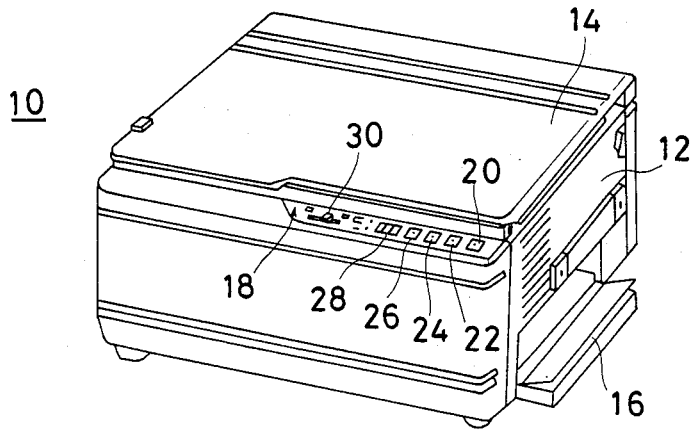
FIG. 1 is a perspective view showing one embodiment in accordance with the present invention.
Figure 2:
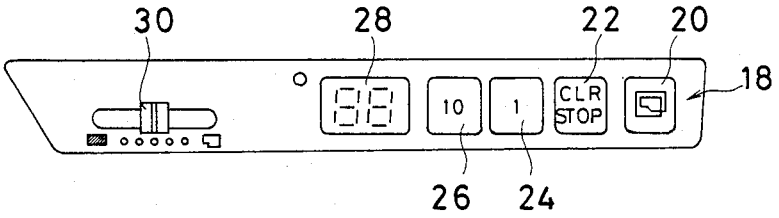
FIG. 2 is an illustrative plan view showing an operation panel in the present embodiment.

FIG. 1 is a perspective view showing one embodiment in accordance with the present invention. Hereinafter, description is made on the embodiment in the case where the present invention is applied to an electrophotographic copying machine. However, it is pointed out in advance that the present invention is applicable to an arbitrary electrostatic recording apparatus, for example, a printer, facsimile or the like in addition to the copier.

An electrophotographic copier 10 comprises a main unit 12. On this main unit 12, an original table 14 is installed so as to be movable reciprocatively in the right and left directions. At one end of the main unit 12, a paperfeeding cassette 16 is loaded in a freely attachable/detachable manner. Accordingly, an original placed on the original table 14 is recorded on a copy paper fed from the paper feeding cassette 16, being discharged to a discharged paper tray (not illustrated) above the paper feeding cassette 16.

An operation panel 18 is installed at the front part of the main unit 12. On this operation panel 18, there are provided a copy start key 20 as a record start key, a clear/stop key 22, a copy quantity setting keys 24 and 26 as record quantity setting keys, a display element 28 for displaying copy quantity and a lever 30 for adjusting copy density.

Of the copy quantity setting keys 24 and 26, the righthand key 24 is for setting the numeric value of the digit "1" and the lefthand key 26 is for setting the numeric value of the digit "10".

When either of the copy quantity setting keys 24 and 26 is depressed continuously, different numerals are displayed in sequence on the display element 28. Specifically, when the righthand key 24 is operated, numerals changing every time are displayed in the sequence of "1→2→3→4→5→6→7→8→9→0→1 - - - " and when the lefthand key 26 is operated, numerals are displayed in the sequence of "no display→1→2→3→4→5→6→7→8→9→no display - - - ".

Figure 3:
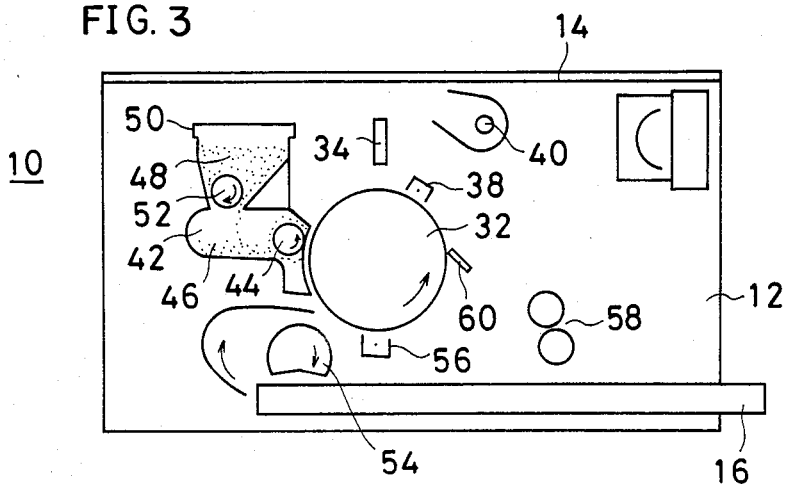
FIG. 3 is an inner structure view showing the present embodiment.

Here, description is made on the inner structure of FIG. 1 embodiment in reference to FIG. 3. On the top surface of the copier main unit 12, as described above, the original table 14 is installed so as to be movable in the right and left directions. This original table 14 is composed, for example, of a clear glass plate, on the top surface of which an original cover is mounted so that it can be opened and closed.

At nearly the center part of the inside of the main unit 12, a photosensitive drum 32, on the peripheral surface of which a photoconductive layer, namely, a photosensitive material, for example, amorphous silicon is coated is installed rotatably in the direction as shown by an arrow mark (counterclock wise). Above the top of this photosensitive drum 32, a short focal distance lens array 34 is mounted fixedly so that the optical axis thereof is set nearly vertically. This short focal distance lens array 34 focuses on original image of the original placed on the original table 14 on the peripheral surface of the photosensitive drum 32.

Also, at the upstream side in the direction of rotation of the photosensitive drum 32 of the short focal distance lens array 34, a charging corotron 38 for uniformly charging the photosensitive drum 32 in a predetermined polarity (for example, positive polarity) is mounted fixedly. Above this charging corotron 38, an exposure lamp 40 for exposing the surface of the original placed on the original table 14 is installed, which is composed, for example, of a halogen lamp.

An electrostatic latent image of the original is formed on the photosensitive drum 32 by means of the charging corotron 38, the exposure lamp 40, the short focal distance lens array 34 and the original placed on the original table 14.

At the downstream side of the short focal distance lens array 34 near the peripheral surface of the photosensitive drum 32, a developing apparatus 42 for developing the electrostatic latent image as described above by the toner is installed. In the developing apparatus 42, a magnet roller 44 is installed free-rotatably and the electrostatic latent image formed on the photosensitive drum 32 is toner-developed by a magnetic brush which is formed of the magnet roller 44 and a developing agent 46. More specifically, for example, the negatively charged toner adheres to the electrostatic latent image formed by positive charge. Thus, the electrostatic latent image formed on the photosensitive drum 32 by the developing apparatus 42 is made into a toner image.

Figure 4:
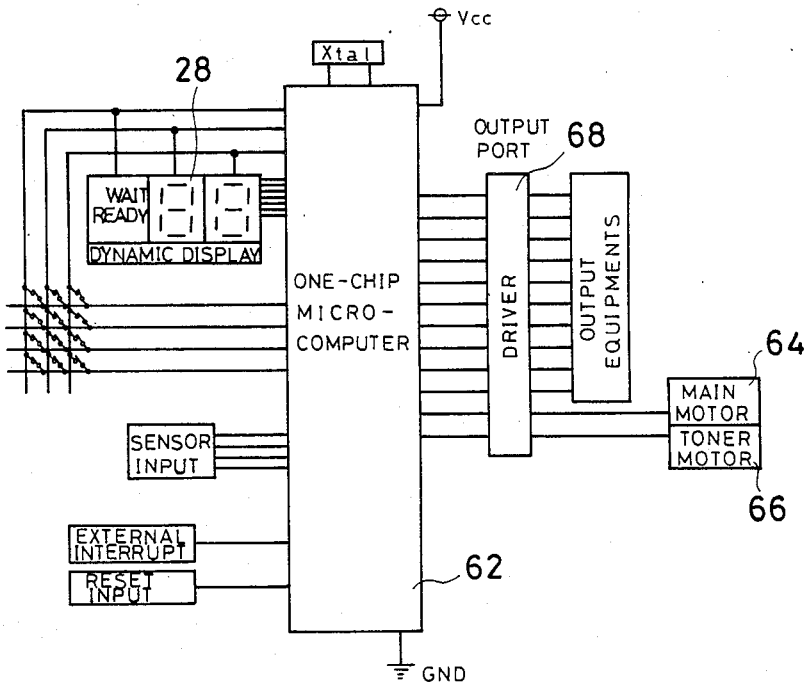
FIG. 4 is a block diagram showing one example of a control circuit in the present embodiment.

A toner hopper 50 wherein a toner 48 forming the above-described developing agent 46 together with a carrier is stored on the top part of the developing apparatus 42. A sponge roller 52 as toner feeding means is attached to the open communicating from the toner hopper 50 to the developing apparatus 42. This sponge roller 52 is connected to a rotary shaft of a toner motor 66 as described later (FIG. 4). When the sponge roller 52 is rotated by the toner motor 66, the toner 48 in the toner hopper 50 is fed into the developing apparatus 42.

Associated with the paper feeding cassette 16, a paper feeding roller 54 is installed and a register roller (not illustrated) is installed behind the paper feeding roller 54. A copy paper sent from the paper feeding cassette 16 by the paper feeding roller 54 is stopped there once by this register roller, thereafter being fed in the direction of the photosensitive drum 32 in synchronism with the movement of the original table 14. Furthermore, a sensor for detecting jam (not illustrated) is installed in the vicinity of this register roller.

A transferring corotron 56 for transferring the toner image developed by the developing apparatus 42 onto the copy paper is installed at a part which is in the vicinity of the side face of the photosensitive drum 32 and whereto the copy paper is fed from the register roller.

A conveying apparatus (not illustrated) for conveying the copy paper whereon the toner image is transferred is installed at the downstream side of the transferring corotron and the copy paper is conveying toward a fixing apparatus.

The fixing apparatus comprises a heat roller couple 58 wherein a heater is incorporated and the copy paper whereon the toner image is transferred is inserted between this heat roller couple 58, thereby being heat-pressed and fixed. Then, a paper discharging roller (not illustrated) for discharging the fixed copy paper on the discharged paper tray is installed at the downstream side of the heat roller couple 58. A sensor for detecting jam (not illustrated) is installed also at the downstream side of this paper discharging roller.

The following is a brief description of the operation of an electrophotographic copier of the present embodiment. An original is placed on the original table 14 and thereafter the copy quantity setting keys 24 and/or 26 are operated to set a required quantity and the start key 20 is depressed and thereby an exposure scanning of the original is performed. That is, the original table 14 moves and the original is slit-exposured by the lamp 40. Light reflected from this original is projected to produce an original image on the photosensitive drum 32 by means of the short focal distance lens array 34 and thereby an electrostatic latent image corresponding to the original image is formed on the photosensitive drum 32. The electrostatic latent image thus formed is toner-developed by the developing apparatus 42.

Such a toner image is transferred on the copy paper fed through the register roller by an action of the transferring corotron 56. The copy paper whereon the toner image is transferred is separated from the photosensitive drum 32, being sent to the fixing apparatus comprising the heat roller couple 58. Then, the transferred toner image is fixed on the copy paper by the heat roller couple 58 and thereafter the copy paper is discharged by the paper discharging roller.

Then, the toner left untransferred is removed from the surface of the photosensitive drum 32 by a cleaning blade 60. Thus, the photosensitive drum 32 wherefrom the remaining toner is removed is charged anew again by the charging corotron 38.

FIG. 4 is a block diagram showing one example of a control circuit of the present embodiment. The control circuit comprises a microprocessor 62 and the above-described display element 28 is connected to this microprocessor 62 through a proper driver unit. A main motor 64 for driving the photosensitive drum 32 and so on and the previously-described toner motor 66 for driving the sponge roller 52 are connected further to the microprocessor 62 through an interface or a driver 68.

Note that FIG. 4 illustrates only the parts associated with the embodiment of the present invention and the other parts are omitted. Also, the usual copying operation is already well known and is not the major part of the present invention and therefore, hereinafter, description on the copying operation is omitted.

Figure 5:
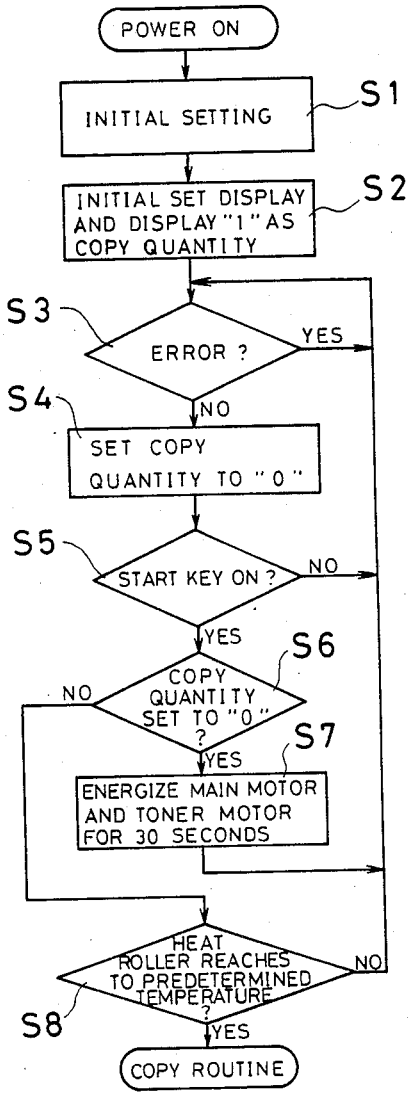
FIG. 5 is a flowchart for explaining operation of the present embodiment.

The operation for feeding the toner 48 from the toner hopper 50 to the developing apparatus 42, with reference to FIG. 5, will now be described.

When the power supply is turned on, first, the microprocessor 62 is initialized in the first step S1. Then numeral "1" for the copy quantity is displayed on the display element 28 in the step S2. Subsequently, presence or absence of jam or the like is detected in the step S3 and if a trouble such as jam or the like is not detected, the processing proceeds to the next step S4.

In the step S4, the operator sets the copy quantity to "0" by operating the righthand copy quantity setting key 24 and thereafter operates the start key 20, then these operations are detected in the steps S5 and S6. Responsively, the microprocessor 62 outputs a signal to a predetermined output port. Consequently, the main motor 64 and the toner motor 66 are energized for a predetermined time, for example, 30 seconds in the step S7. Then, attending on these energizations, the sponge roller 52 (FIG. 3) is rotated for a predetermined time, for example, 30 seconds and a predetermined amount of toner 48 is fed from the toner hopper 50 to the developing apparatus 42. In this duration, the main motor 64 continues to rotate and this rotation executes the processes such as equalizing the surface potential of the photosensitive drum 32 and the like.

If a copy quantity of "1" or more is set in the step S6, the microprocessor 62 detects whether or not the heat roller couple 58 has reached the temperature required for fixing in the step S8 and if the temperature has been reached, the processing proceeds to the usual copy routine.

Meanwhile, in the above-described embodiment, the sponge roller 52 is rotated for a predetermined time by operating the copy quantity setting key 24 and the copy start key 20. However, the sponge roller 52 may be operated by operating other keys, for example, by operating the clear/stop key 22 and the copy quantity setting key 26 and further still another arbitrary combination of the operating keys can be made.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrostatic recording apparatus comprising:

a photosensitive body whereon an electrostatic latent image is formed, developing means which develops said electrostatic latent image by means of a toner, a toner hopper wherein a toner is stored, toner feeding means for feeding the toner from said toner hoper to said developing means, a plurality of operating keys, and means for operating said toner feeding means for a predetermined time in response to one of a simultaneous and a sequential operation of at least two operating keys, the operating means being nonresponsive to the operation of just one of said keys.

2. An electrostatic recording apparatus in accordance with claim 1, wherein said plural operating keys include a record quantity setting key and a start key; and wherein the means for operating said toner feeding means is responsive to an operation of said start key after numeral "0" has been set by operating said record quantity setting key.

* * * * *